United States Patent [19]

Boyd

[11] 4,026,263

[45] May 31, 1977

[54] FIREPLACE SYSTEMS

[76] Inventor: Charles M. Boyd, P.O. Box 634, Fort Collins, Colo. 80522

[22] Filed: Jan. 2, 1976

[21] Appl. No.: 646,251

[52] U.S. Cl. ..... 126/121; 126/135; 126/164; 237/51

[51] Int. Cl.[2] ..... F24B 7/02; F24B 7/04

[58] Field of Search ..... 126/63, 121, 122, 131, 126/135, 163 R, 163 A, 164, 120, 123, 124; 237/51

[56] References Cited

UNITED STATES PATENTS

| | | | |
|---|---|---|---|
| 1,008,480 | 11/1911 | Latta | 126/163 R |
| 1,706,768 | 3/1929 | Brewster | 126/121 |
| 2,231,258 | 2/1941 | Elmore | 237/51 |
| 2,258,882 | 10/1941 | Craig | 126/121 |
| 2,322,016 | 6/1943 | Hardeman | 237/51 |
| 2,470,430 | 5/1949 | Carter | 126/120 UX |
| 2,747,568 | 5/1956 | Dupler | 237/51 X |
| 2,789,554 | 4/1957 | Dupler | 126/121 X |
| 3,834,619 | 9/1974 | Glover | 126/121 X |
| 3,938,496 | 2/1976 | Kampf | 126/121 |
| 3,942,509 | 3/1976 | Sasser | 126/121 |

*Primary Examiner*—Robert G. Nilson
*Attorney, Agent, or Firm*—Hugh H. Drake

[57] ABSTRACT

A fireplace is designed for installation in an enclosure such as a house. It includes a firebox for confining the combustion region. Of course, it has an exhaust outlet. A heat-exchange system is in heat-transfer relationship with the firebox. An air supply feeds air from outside the enclosure. A circulation system conducts air through the heat-exchange system and in communication with the enclosure. A control arrangement governs the conveyance of air from the supply to both the firebox and the heat-exchange system. A thermostat system within the enclosure operates the control means in response to temperature changes. Outside air is utilized both to control the degree of combustion and in the operation of the circulation system that heats the enclosure. A hollow grate system enhances efficiency.

35 Claims, 10 Drawing Figures

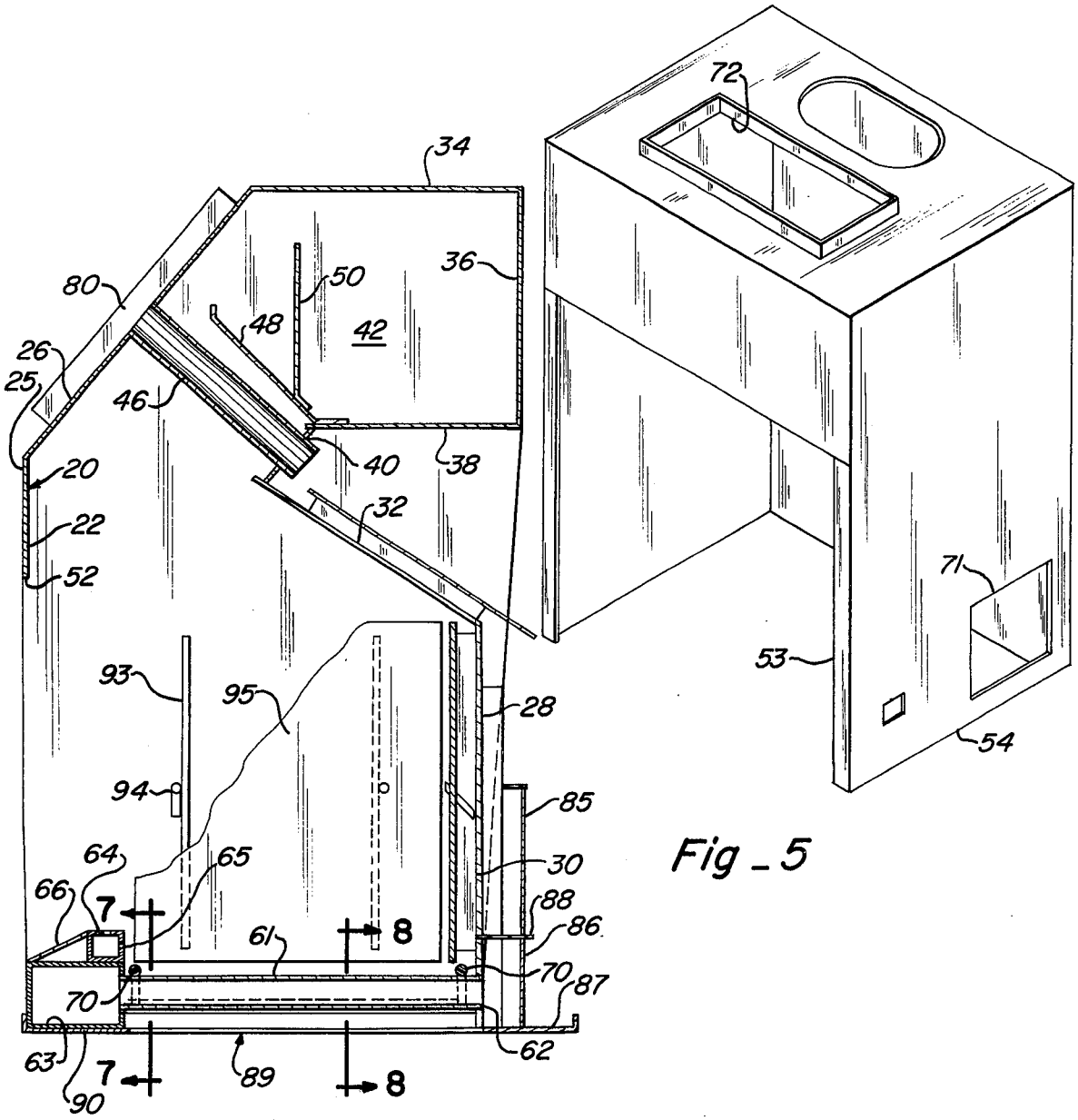
Fig_5
Fig_6
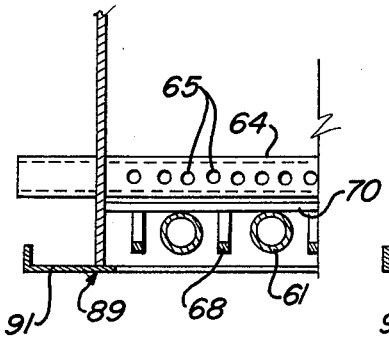
Fig_7
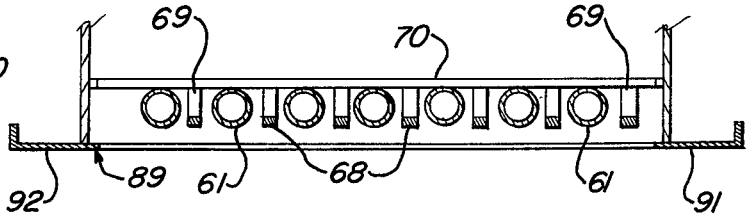
Fig_8

FIREPLACE SYSTEMS

The present invention pertains to fireplace systems. More particularly, it relates to fireplaces, such as one to be installed in a conventional home, that enables the user to operate the fireplace while enjoying the benefit of increased efficiency of operation.

The ordinary fireplace may be defined as a fire-protected hole in the wall which communicates with a chimney for the purpose of carrying off products of combustion. That chimney, of course, is absolutely necessary in order to remove undesired combustion products such as smoke. At the same time, however, it also conveys a very large portion of the generated heat out of the building, instead of permitting it to be used for the original purpose of heating the interior of the building.

In recognition of this inefficiency in the most simple type of fireplace, various approaches have been taken to the end of better transferring at least some of the heat of combustion into the enclosed area. Such approaches have included heat-transfer vents surrounding the firebox so as to cause heat in the region of the exterior of that firebox to be conveyed into the interior of the enclosure, either by gravity or by mechanically forcing blower.

Seeking to further improve the efficiency of the rather ordinary fireplace, it has been suggested that external air be conveyed through hollow tubular portions of a grate unit upon which the fire is caused to exist. That approach has the advantage of better transmitting the produced heat to the interior, while at the same time tending to combat the drawing of air from other portions of the enclosure supporting the combustion within the fireplace and the natural draft which occurs up the chimney.

Notwithstanding the foregoing prior knowledge, it is still the custom of the day to install a fireplace in a manner in which it depends upon internal air for the source of oxygen to sustain combustion. Not only does a major portion of the heat generated by the burning action within the fireplace go up the chimney or stack, but tests have shown that heat developed by other heating sources within the building also is wasted through the chimney effect simply by reason of the burning within the fireplace.

It is, accordingly, an overall object of the present invention to provide a new and improved fireplace system which overcomes the deficiencies and other undesirable attributes of fireplace systems such as those adverted to above.

Another object of the present invention is to provide a fireplace system which enables efficient utilization of the heat available from burnable materials without detracting from the efficiency of any additional heating system that may be provided for the enclosure.

A further object of the present invention is to provide a new and improved fireplace system which is capable of functioning in at least major proportion as the primary heating unit of an enclosed structure.

Still another object of the present invention is to provie a new and improved fireplace system which enables the efficient use of firewood of a wide variety of sizes and without the need for the splitting of such firewood.

A still further object of the present invention is to provide a new and improved fireplace system which enables a constant temperature to be maintained in the enclosure being heated.

In general, the aim is to provide a better fireplace than has heretofore been suggested or made available.

A fireplace system installed in accordance with the present invention includes a firebox installed within an enclosure and which confines the region of combustion of burnable products. There is, of course, an exhaust outlet from the firebox. A heat-exchange system is in heat transfer relationship with the firebox. An air supply is capable of feeding air from outside the enclosure. A circulation system conducts air through the heat-exchange system and is in communication with the enclosure. Control means governs the conveyance of the air from the supply to at least one of the firebox and heat exchange system. Finally, a thermostat means within the enclosure enables or disables the control means in response to temperature changes within the enclosure. Preferably, the air supply means is capable of feeding outside air both to the process of combustion and to the circulation system of heating. Various temperature-cognizant means desirably are included for the purpose of enabling a maximum of flexibility in insuring efficiency of operation and propriety of control. Various other features include an efficient grate structure and a manner of supplying combustion air so as to form a screen.

The features of the present invention which are believed to be novel are set forth with particularity in the appended claims. The organization and manner of operation of the invention, together with further objects and advantages thereof, may best be understood by reference to the following description taken in connection with the accompanying drawings, in the several figures of which like numerals identify like elements, and in which:

FIG. 5 is a perspective view of another component of the system;

FIG. 6 is a cross-sectional view taken along the line 6—6 in FIG. 3, with some of the parts omitted for clarity of presentation;

FIG. 7 is a fragmentary cross-sectional view taken along the line 7—7 in FIG. 6;

FIG. 8 is a fragmentary cross-sectional view taken along the line 8—8 in FIG. 6;

Figure 1:
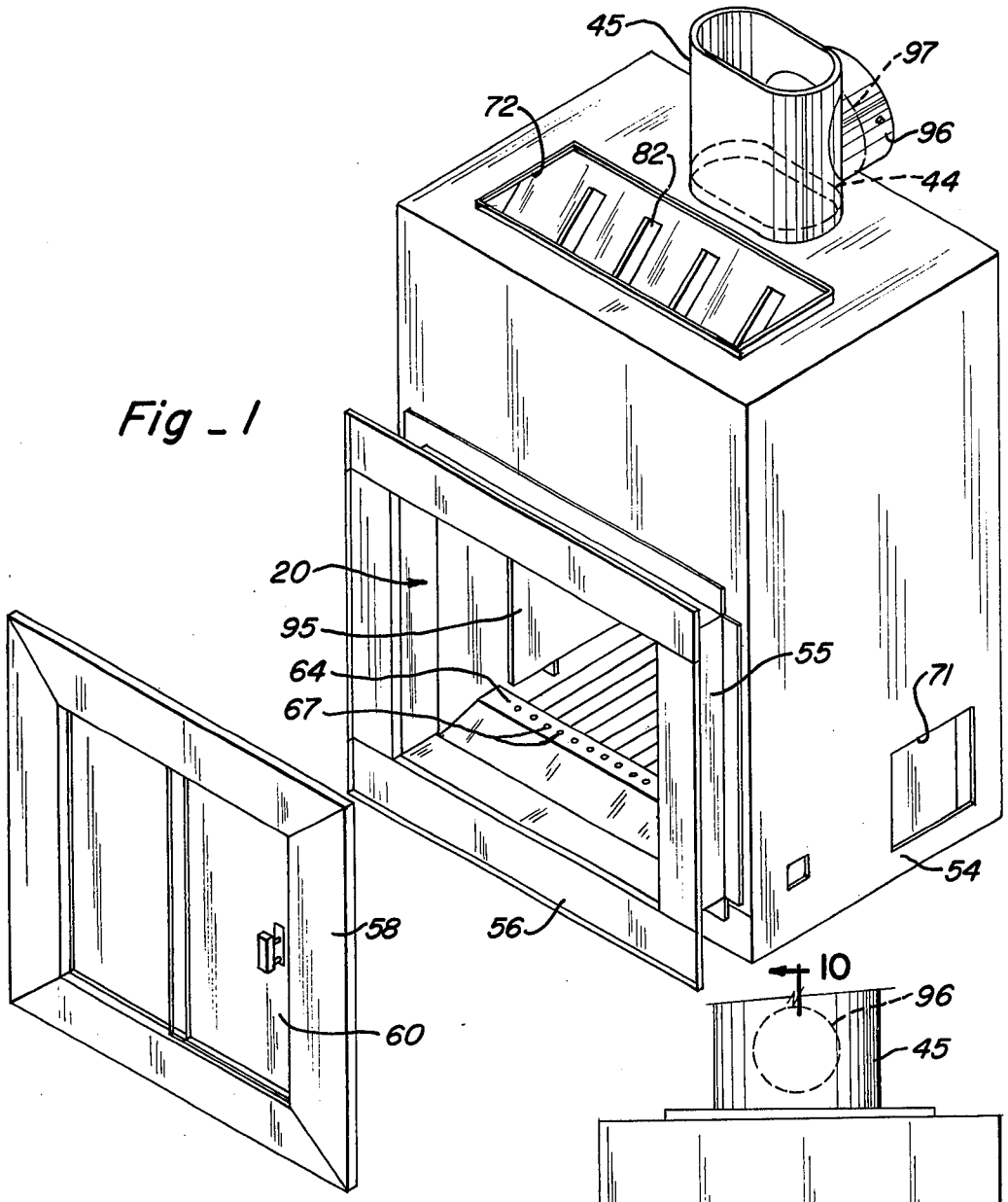
FIG. 1 is an exploded perspective view of a fireplace system.
Figure 2:
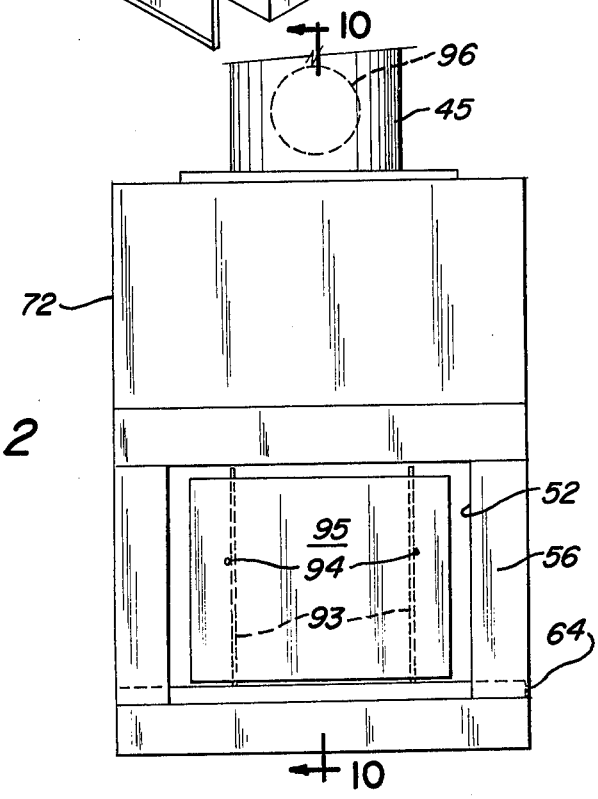
FIG. 2 is a front elevational view of a portion of the system of FIG. 1.
Figure 3:
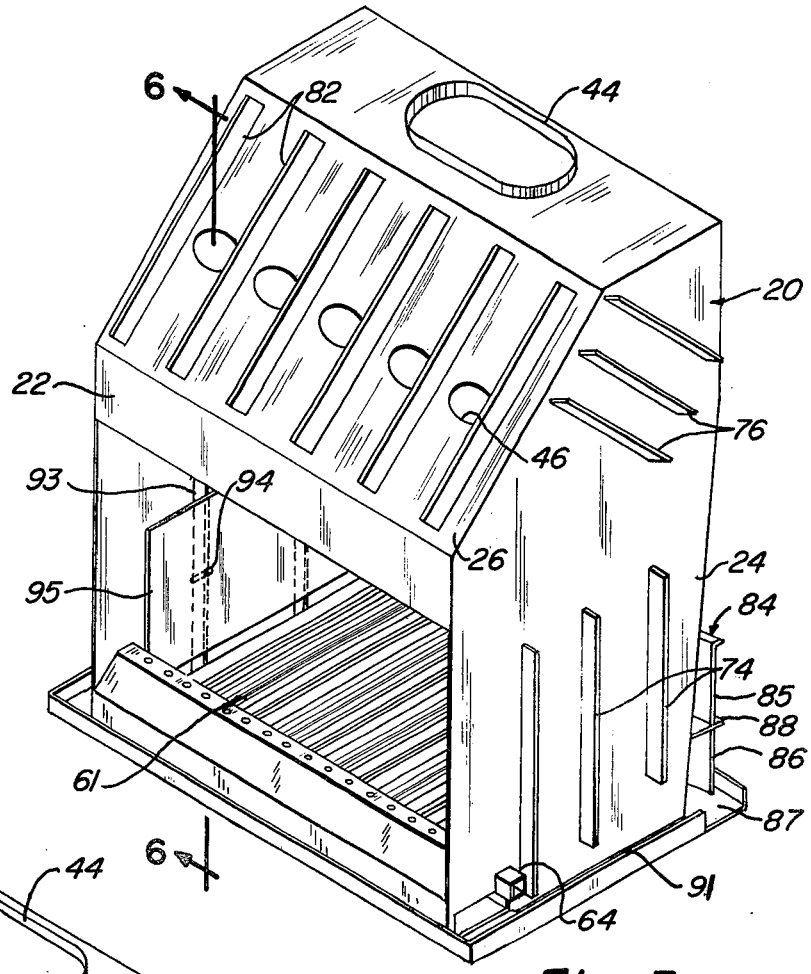
FIG. 3 is a perspective view of a principal component of the system.
Figure 4:
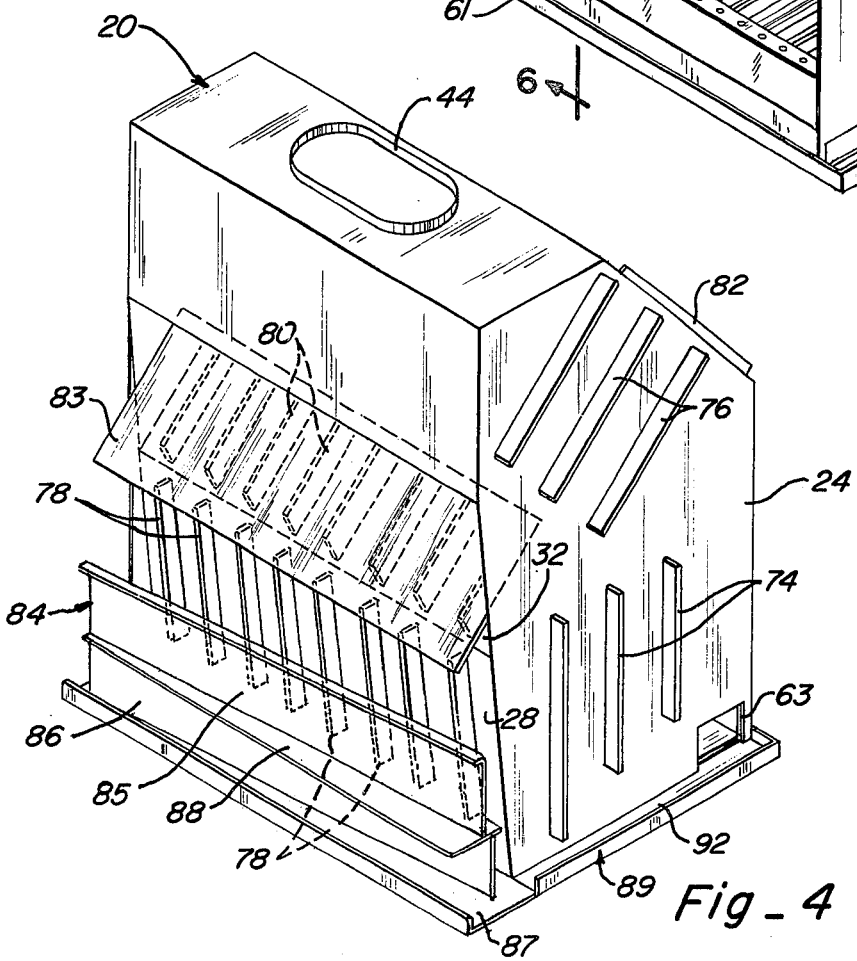
FIG. 4 is a reverse perspective view of that same component.

A fireplace system includes a firebox 20 formed of a heat-conductive material such as sheet steel. Firebox 20 confines a region of combustion of burnable products such as firewood. In itself, and for the most part as best shown in FIG. 6, firebox 20 includes a front wall 22 bridging sidewalls 24 and disposed vertically over its lower portion 25 and slanting inwardly and upwardly over its upper portion 26. A rear wall 28 is vertically disposed over its lower portion 30 and is formed to slant upwardly and forwardly throughout its upper portion 32. Additional wall sections 34, 36, 38 and 40 serve to define a smoke shelf 42.

Opening upwardly from smoke shelf 42 is an exhaust outlet 44 for conveying the combustion products on through the usual chimney or stack 45. Slanting upwardly and forwardly through shelf 42, and between wall sections or portions 26 and 40, are a plurality of conduits 46. A baffle sheet 48 slants upwardly from wall section 38 generally alongside the uppermost surface of conduits 46. Another baffle 50 projects upwardly from the forward margin of wall portion 38 but has its own margins spaced from the wall portion 34 and the sidewalls so as to permit upwardly rising smoke to egress through outlet 44 around the edges of this particular baffle. Baffle 50 chokes off the central region of the smoke path, preventing backward eddy currents.

Defined in front wall 22 is an opening 52 through which fuel to be consumed is inserted and ignited. Opening 52 is aligned with an opening 53 in an outer jacket 54 that encloses firebox 20. A collar 55 has an out-turned flange which is fastened and sealed around and to the margins of opening 53, while defining a door holder flange 56. A door frame 58 carrying a pair of sliding fire doors 60, preferably composed of transparent glass, is secured to flange 56. As illustrated, frame 58 is spaced by collar 55 from jacket 54 by a distance to accommodate the brick or stonework that forms the aesthetically attractive wall through which the fireplace opens. In the manner shown, collar 55 is removably affixed to jacket 54. This reduces considerably the clearances necessary to move the main part of the fireplace unit into a given enclosure. Both its front and rear flanges enables air tight sealing to associated surfaces, for reasons better to be appreciated later in connection with this description. Flange 56 also has out-turned flanges that serve as a guide for the laying of brick or stone. A baffle 59 projects downwardly and rearwardly of the top panel of collar 55 for the purpose of preventing an internal circulating current of smoke toward fire doors 60. Desirably, collar 55 may be circumscribed by a sleeve of insulating material. That technique can permit a zero-tolerance fit in the wall opening. Also, the insulation value serves to reduce radiation losses. The same approach may be used over the entire external surface area of the structure to be described.

A plurality of laterally-spaced tubes 61 are oriented so as to open at one end 62 through rear wall lower portion 30 and emerge at the other end in a manifold 63 which runs crosswise along the bottom of opening 52. Also running transversely to opening 52, generally along its lower portion and spaced somewhat inwardly thereof, is a pipe 64 through the back surface of which is defined a plurality of longitudinally spaced combustion air outlets 65. A strut 66 extends between the front-top edge of pipe 64 and the upper wall of manifold 63 for both strength-giving and appearance purposes. A series of small apertures 67 are spaced along the upper surface of pipe 64 so as, in use, to form an air screen.

Successively spaced individually between different ones of tubes 61, and oriented near the lower portions thereof, are a plurality of bars 68 which serve to collect ignited coals are retain the same in a position adjacent to the tubes. Bars 68 are suspended by a plurality of straps 69 that depend from a pair of rods 70 disposed transversely across the top of tubes 61 respectively near the front and rear thereof. Bars 68 each so fill the space between adjacent ones of tubes 61 as to hold embers until they are reduced at least substantially to ashes.

A conventional firebox usually has a small opening more or less centrally located in its floor and through which ashes may fall or be swept. As herein contemplated, the entire area beneath the grate defined by tubes 61 is open to an underlying ashpit. Typically, that ashpit is constructed of brick, cement block or poured concrete and includes access for eventual ash removal. In terms of user efficiency, this "open" ashpit approach becomes an integral part of the complete-combustion concepts enabled by the present system and apparatus.

Outer jacket 54 encloses firebox 20. As illustrated, jacket 54 is in itself a similar metallic enclosure the walls of which are generally spaced from the walls of firebox 20. Jacket 54 defines or accommodates front opening 53, outlet 44, pipe 64, an air return inlet 71 and a heated-air plenum opening 72. However, jacket 54 may be constructed during installation of a fireplace so as to be composed of brick or stone materials. In any event, a variety of heat-conductive spaced-apart fins project outwardly from firebox 20 and into the space defined by jacket 54. The first succession of such fins 74 are generally vertically oriented and are disposed on a lower portion of sidewalls 24. Another set of such fins 76 extend generally upwardly and forwardly along the upper portions of sidewalls 24. A still different set of fins 78 are vertically oriented along rear wall 28. Also generally in an upright position, a set of fins 80 are spaced apart across the width of upper portion 32 of the rear wall of the firebox. Finally, a similar set of fins 82, also with a generally upright orientation, are distributed across the upper portion 26 of the front wall of the firebox.

Spaced above and parallel to fins 80 is a baffle 83 the lower margin of which projects rearwardly beyond rear wall 28. Laterally spanning fins 78, below the lower margin of baffle 83, is a deflector assembly 84. Within assembly 84, upper and lower vertically oriented vanes 85 and 86 slant inwardly toward wall 28 from the region of inlet 71 to the opposite rear corner of firebox 20. Vane 86 is upstanding from a base member 87, while a horizontal web 88 separates vanes 85 and 86 and defines with the latter a pair of wedge-shaped air-supply channels. When installation requirements dictate a different location for inlet 71, deflector assembly 84 is, of course, modified to achieve the equivalent results.

Firebox 20 rests on a baseplate 89 that has a member 90 across its front and two rearwardly extending legs 91 and 92 at either side. Up-turned edge margins accommodate jacket 54. The central open space within baseplate 89 is above the ashpit. During installation, all exposed marginal joints are sealed with asbestos cement.

Secured on the interior surfaces of sidewalls 24 and rear wall 28 are pairs of spaced vertical brackets 93 from which project upwardly slanting posts 94. Lending protection to these walls are respective fireplates 95 that have apertures to receive posts 94 and which are so located as to position the fireplates at the corresponding ends and the back of burning logs.

Projecting laterally from stack 45 is a barometric damper 96 which is, in itself, conventional. That is, its internal valve flap 97 is counterweighted so as normally to enable just enough stack suction in the firebox to remove the combustion products. However, flap 97 opens further to let in additional air when high wind across the top of the stack increases the updraft. Departing from the conventional, damper 96 in this case communicates with a source of air from outside the enclosure being heated.

The fireplace system is, of course, designed to be installed in connection with the heating of a residence or other enclosure. Included in the overall system for completing the operation of that which has already been described is an electrical control network preferably of a form depicted in FIG. 9. This network includes a main supply electrical breaker 100 from which extends common leads 102, 104 and 106 respectively to a circulation fan 108, a combustion air fan 110 and a transformer 112. Common lead 102 also is extended to a transformer 114. A hot lead 116 extends to one side of a low-limit switch 118 and thence to one side of a start switch 120. Switch 118 preferably is located on one of sidewalls 24, so as to be sensitive to a substantially cool condition of the firebox. The other side of switch 120 is connected to the opposite end of switch 118 from which connections also are made to the hot side of fan 108 and one side of a relay 122. The other side of relay 122 is returned to combustion air fan 110 for the purpose of energizing the latter. Relay 122 is powered from transformer 112 through the operation of a high limit switch 124. Similarly, transformer 114 supplies low-voltage energizing power through the operation of a low-limit switch 126. High limit switch is located within the enclosure served by the fireplace and is so connected with transformer 112 and switch 122 as to complete a series-energization circuit through a high limit switch 128 located to sense the temperature at plenum opening 72. Low limit switch 126 also is located within the enclosure and is parallel connected with respect to both a low-limit switch 130, also located to sense the plenum temperature, and transformer 114 which is associated with a relay switch 132.

Switch 132 serves to power a cooling fan 34 that supplies air drawn from outside the enclosure being heated by the fireplace system. As herein contemplated, that source of "outside" air may be simply coupled into the back or rear side of jacket 54 so as to vent such outside air into the circulation system which involves the air within the interior of the enclosure. Alternatively, the outside air may be fed into a heating duct system plenum affixed to the collar of opening 72. In addition, such outside air also is forced by fan 110 into pipe 64 so as to serve as a source of combustion air through outlets 65, while at the same time establishing an air screen just within and across opening 52 by means of air flow through apertures 67.

Of course, the particular arrangements of the ductwork external to firebox 20 and jacket 54 may vary widely to accommodate different features of building structure. In principle, circulation fan 108 may be located anywhere within a main trunk of the interior air distribution system. Combustion air fan 10 and cooling fan 134 may be located wherever convenient between a source of outside air and their respective input couplings into the remainder of the system. In one approach, jacket 54 projects into a separate equipment room that is not heated by the interior air distribution system. This room is freely vented to the outside air. Thus, the intakes to fans 110 and 134, as well as damper 96, open directly into the room.

Preferably, circulation fan 108 is located in the main trunk of the "cold" air return from the interior air distribution system. Of course, that permits the fan to operate at lower temperatures. In any event, the circulating air entering through inlet 71 is separated by web 88 so that one portion is deflected by vane 86 over the lower parts of ribs 78 and into grate tubes 61. Another portion of the incoming air is deflected by vane 85 over the upper parts of ribs 78 and then by baffle 83 so as to flow along ribs 80 and into conduits 46. Some of the heated air emerging from conduits 46 is deflected, by the upper wall of jacket 54, downwardly along sidewalls 24 and ribs 74 and 76 of the firebox. Heated air emerging from manifold 63 tends to rise along those sidewalls and ribs. The seemingly conflicting flow paths along sidewalls 24 and fins 74 and 76 serve to introduce a degree of turbulance that enhances heat transfer to the moving air from the sidewalls and fins.

Having thus described the principal overall components and flow paths of the structure and the system, a discussion of operation will ensue. Basically, a first principle is that air from outside the enclosure is to be utilized for supporting combustion with firebox 20. While firedoors 60 may at times be left open by the user simply for the purpose of enjoying the more immediate presence of the flames of combustion, most efficient operation will be obtained when the combustion air system is entirely separated from the heating air system through the closure of those firedoors. Combustion air is introduced so as to flow into pipe 64, exhaust into the interior of the firebox and, should there be any excess, flow upwardly through smoke chamber 42 and out exhaust outlet 44 along with the combustion products.

Quite apart from the supply and use of the combustion air, it is apparent that the remainder of the unit acts as a heat exchanger. Some of the circulating air, which may include outside air, is brought through grate tubes 61, exhausted from manifold 63, and caused to flow in a surrounding relationship to the outer surface of the walls of firebox 20, and thus within jacket 54, so as to be in heat-exchanging relationship with a number of the different fins that have been described. Additional air is caused to be conveyed through conduits 46 which are directly in the path of the highly heated exhaust gases emerging from the firebox and out of exhaust outlet 44. Of course, the circulating air passing through the interior of jacket 54 and through conduits 46 is caused by fan 108 to emerge into the interior of the surrounding enclosure; fan 108 runs continuously whenever power is supplied to the system. In the simplest installation, internal air circulation may be achieved by the provision of an outlet in the wall and over the inside upper extent of the fireplace system; on the other hand, that very same heated air in the circulating system preferably is directly coupled into a heating duct system that extends throughout the enclosure. The latter may be the same heating duct system conventionally connected to an electric, gas or coal fired separate heating unit.

In contemplation of incorporating the best-possible mode of embodiment, the system as presented includes both the use of grate tubes 61 and the fin-and-jacket system, as well as the incorporation of conduits 46, all as part of a heat-exchange system. It is to be recognized, however, that lesser portions of all of such an approach may be incorporated into a particular system, especially when one is modifying an existing system wherein the economics or aesthetics will not permit a complete incorporation of everything herein disclosed.

Figure 9:
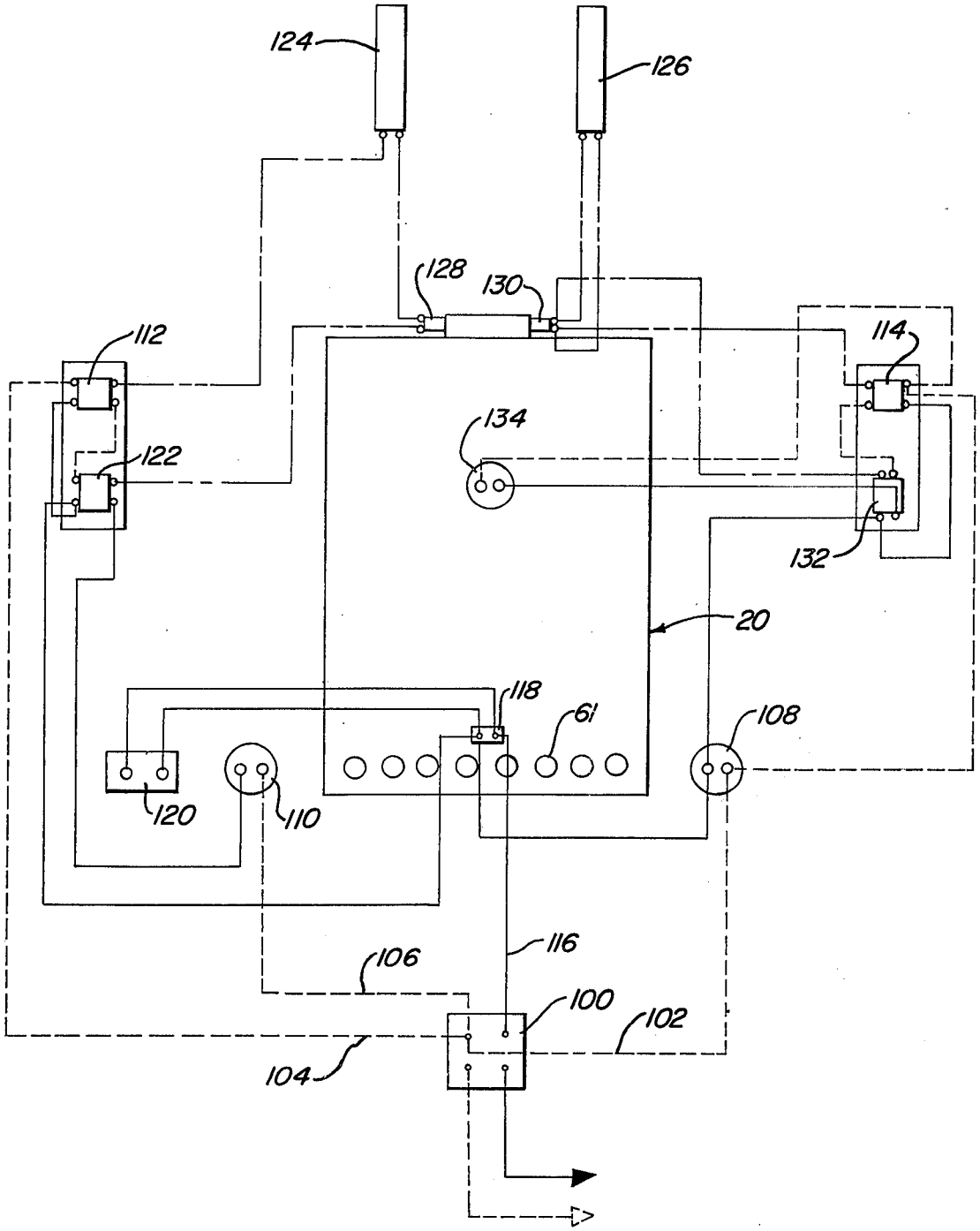
FIG. 9 is a schematic diagram of a control arrangement used with the system of the preceding figures.
Figure 10:
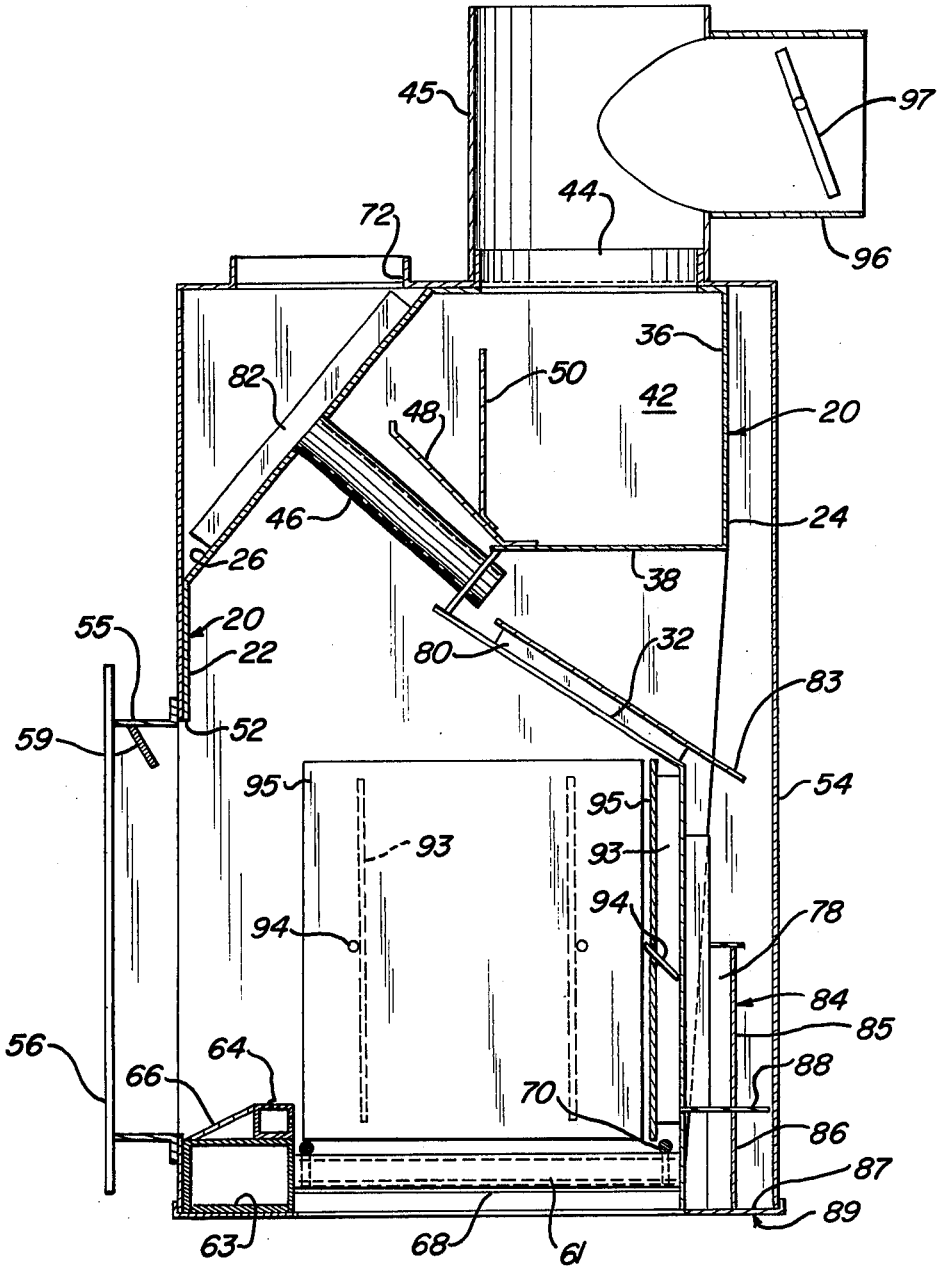
FIG. 10 is a cross-sectional view taken along the line 10—10 in FIG. 2.

With reference again to FIG. 9, it will be observed that the control system disclosed governs the conveyance of air from an outside supply preferably to both the firebox and the heat exchange system. In FIG. 9, solid lines indicate the "hot" side of the basic electrical power supply, dashed lines represent the neutral of that supply, and solid-dashed lines represent low-voltage control wiring. Included within the enclosure heated is a thermostat that enables and disables the control system in response to a temperature change. When the control system governs the conveyance of air from the supply to the firebox, as through pipe 64, the thermostat effects operation of the control means to at least reduce a supply of air from fan 110 to the firebox upon increase to a preselected value of temperature as determined by switch 124. At the same time, preferably, the system further includes a temperature sensing means, such as high limit switch 128, located within the heat-exchange system established by jacket 54. Switch 128 effects operation so as at least to reduce the supply of air, by means of blower 110, and thereby decrease the supply of air to the firebox upon increase to a predetermined value of the temperature in the heat exchange system. Important to starting of the system is the inclusion of manually-operable switch 120, so as to be able to effect operation of the combustion air supply control means for the purpose of conveying air until limited by the other thermostatic means and without limitation by low limit switch 118. Adding to the flexibility of operation is the inclusion of low-limit switch 126 which operates the outside fresh air-supply control in order to effect operation of that control so as to increase the supply of air to the overall heat-exchange system when the enclosure temperature exceeds a predetermined value. Still further, temperature-detecting switch 130 acts as a part of the heat-exchange system so as to control the supply of outside air in order to increase its amount when the temperature in that system exceeds a predetermined value.

That is, the temperature-responsive means, as exemplified by switch 126, acts to disable the controlled outside supply in response to a temperature drop within the enclosure. That response is also made effective to control the operation of the air supply by increasing the supply of air to the heat-exchanger system when the temperature therein exceeds a selected limit. Moreover, the system also includes a feature in which the temperature-determining means ascertains the existence of combustion heat level within the firebox and, in response thereto, controls impelling means for the input of outside air. It may also be observed that the arrangement of FIG. 9 affords a high degree of safety in operation. That is, high-limit sensors 124 and 128 are connected in a series loop with transformer 112, so that failure of any of those units results in a shut down of combustion fan 110. Reversely, low-limit sensors 126 and 130 are parallel-connected to transformer 114 in control of cooling fan 134, so that failure of either one of those sensors will not prevent the other from bringing in cool air when a severe temperature overrun might tend to occur. Moreover, the high-limit and low-limit systems back-up each other in such an eventuality. This latter back-up is augmented by the fact that cooling fan 134 and circulating fan 108 have much greater capacities than that of combustion fan 110.

Despite the above description, the end result is a fireplace system or unit which looks like a conventional fireplace. That is, it burns wood or the like for the purpose of generating a flame that is pleasantly observable. Contrary to the usual fireplace, this is a type of unit which achieves its end by the use of air circulating means, such as blowers, and in which, when the fire is extinguished, shuts off automatically.

As will be observed from the foregoing, the blower mechanism 108 which circulates interior room air runs constantly when the unit is hot. Combustion air is introduced only if thermostat 124 is set above room temperature and calls for heat; that will shut off when the room temperature reaches the thermostat setting or whenever the plenum achieves its maximum desired temperature. Fresh air will be supplied whenever the room temperature reaches the setting of cooling thermostat 126 or whenever the plenum temperature exceeds a predetermined value. Fresh air blower 134 operates the same as an air conditioner. All power to the overall unit is controlled by low-limit thermostat 118 which turns off such power when the fire is exhausted. Thus, manual switch 120 is provided in order to enable start-up. On the other hand, that manual starting switch is so incorporated as not to interfere with the automatic control of the fire or of the temperature within the enclosure.

To start the unit properly, one first should set thermostat 124 above internal room temperature. Something of the sort of wadded-up paper is placed across the front of the grate. Four or so pieces of wood, perhaps between one inches and four inches in diameter, are then placed over and to the back of the paper, preferably making sure that the wood does not rest directly on the paper. The paper is then lighted along its front edge in two or three places. Doors 60 are then closed and start switch 120 is turned on. When the supplied wood is burning well, and this may not be until it is practically formed into complete coals, larger logs, typically between four inches and twelve inches in diameter, may be added. With the doors 60 again closed and thermostat 124 set as desired, the fireplace system tends to take care of itself automatically until more wood is needed. To be sure, the system is of a type which requires a certain amount of experience in obtaining maximum efficiency and ease of operation. For example, upon first starting, the air in the plenum may become sufficiently hot to cause cooling fan 134 to operate before the enclosure is really up to temperature. Generally, that indicates the initial supply of too much wood or of wood that has too small of a diameter. In time, the user will learn to adjust the size and amount of wood to avoid that result. A user may wish to reduce the thermostat setting just as soon as the wood is burning well. That will tend to cause the wood to burn longer. It is suggested that dried logs be mixed with green logs; experience will provide evidence of the proper mixture of those two types of logs in order to yield the longest burn for the amount of heat desired.

When the fireplace system is connected into another heating system, it may be appropriate to set thermostat 124 on the fireplace system just below the setting for the thermostat which controls the other source of heat. In that way, the wood or other combustible material in the fireplace tends to burn more slowly and the other source of heat becomes active just enough as needed to keep the house or other enclosure at a desired temperature. In many situations, the user may desire to burn the fireplace system only in the evening. In that case, the source of heat supplied by the other unit might have its thermostat set below the setting for the fireplace unit herein disclosed, reversing those settings only when retiring for the night. At the same time, it may be desired to allow the fireplace unit herein described to provide its maximum total heat, until the wood or other combustion product is thoroughly used, by leaving its controls set so as to provide all heat until the wood is done.

Burning flames in the fireplace are indeed attractive at times. To that end, the user may desire to leave fire doors 60 open and have visual access to an open fire. If so, it is advisable that thermostat 124 be turned down so as to reduce the supply of outside combustion air at such time. This condition will tend to burn much more fuel in the fireplace. Moreover, the entire enclosure may cool down, because draft air can be brought from elsewhere from within the enclosure to supply combustion.

It will be observed that the heating system herein described offers a fireplace-type unit that enables the retention of the natural beauty of such a fireplace. Unlike the ordinary fireplace, however, it offers complete thermostatic control of the temperature within the house and the maintenance of a constant temperature throughout. The glass doors, known as such, which enclose the front of the fireplace contribute to the unique design of the closed-system heat exchanger; it actually is an efficient wood-burning forced-air furnace, while yet being built like a fireplace. When installed in a house or like enclosure, the overall system may be connected to a central heating system in the same way as air conditioning is connected. Alternatively, it may have its own distribution system. In tests in a normal size fireplace, it has exhibited the ability of contributing in excess of 100,000 but/hour input air into a building.

By reason of the introduction of outside combustion air, the system is extremely fast starting-like when using a bellows. All combustion and flue air utilized in this system in desired operation is from the outside of the building; this reduces the chance of heat loss from inside. Within the air circulation-unit, outside air is controllably mixed with room air. This forces the introduction of fresh, and yet warmed, air throughout the house, adding oxygen while limiting stagnate air conditions. Desirably, the system is run so as to create a positive pressure within the house. Such a condition reduces drafts and eliminates any danger of drawing combustion fumes from water heaters or other furnaces. The expenditure of wood or other combustion products is reduced, because the amount of supplied combustion air is controlled by thermostatic means. With the system herein disclosed, operation may be conducted under conditions in which replacement fuel may be required only at as little as every 12 hours. Moreover, economical cuts of wood, such as rough-cut logs having diameters of up to perhaps 12 inches, and even some green wood, may be utilized. Of course, that cuts cost or time in connection with the splitting of logs for use in such a fireplace. The unit is designed so as to shut off as the fire goes out. There is no damper to close after the fire goes out, or any damper to leave open at the last of the fire production so as to exhaust the remaining gases while yet using up or exhausting interior heat.

The entire discussion above has been directed to what is a hot-air furnace. A number of features, however, are equally applicable to a hot-water system. That is, the liquid fluid is caused to flow through grate tubes 61 and conduits 46 by means of piping interconnecting the flow paths and, preferably, extending through or in integral contact with the different fins. The combustion-air supply and control system may remain the same. Circulating fan 108 becomes a pump. Outside air is introduced into and exhausted from the plenum region on demand for cooling by means of heat-exchange with the conducted liquid. Of course, that would typically involve coiled or otherwise re-entrant loops of the liquid-carrying conduit in the path of the air. Alternatively, or in addition, fresh, outside air could be introduced directly into the enclosure.

While a particular embodiment of the present invention has been shown and described, and various suggestions for modification have been included, it will be obvious to those skilled in the art that changes and modifications may be made without departing from the invention in its broader aspects, and, therefore, the aim in the appended claims is to cover all such changes and modifications as fall within the true spirit and scope of the invention.

I claim:

1. A fireplace system installed within an enclosure and comprising:

a firebox of heat-conductive material for confining the region of combustion of burnable products;

means defining an opening in the front of said firebox for enabling the insertion into said firebox of burnable products to be consumed;

an exhaust outlet for the egress of combustion products from said firebox;

a heat-exchange system in heat-transfer relationship with said firebox;

an air supply capable of feeding air from without said enclosure;

a circultion system for conducting air through said heat-exchange system and in communication to and from said enclosure;

control means for governing the conveyance of air from said supply to at least one of said firebox and said circulation system;

thermostat means within said enclosure for enabling and disabling said control means in response to temperature cha.ıge within said enclosure;

and means, including a selectively openable closure for said opening, for at least essentially completely separating the flow of air in said circulation system from the flow of combustion air into said firebox and the egress of combustion products from said firebox.

2. A system as defined in claim 1 in which said control means governs the conveyance of air from said supply to said firebox, and in which said thermostat means effect operation of said control means to at least reduce the supply of air to said firebox upon increase to a preselected value of said temperature.

3. A system as defined in claim 1 in which said control means governs the conveyance of air from said supply to said firebox, which further includes temperature-sensing means within said heat-exchanger system, and in which said temperature-sensing means effects operation of said control means to at least reduce the supply to air to said firebox upon increase to a predetermined value of the temperature in said heat-exchanger system.

4. A system as defined in claim 3 in which said thermostat means also effects operation of said control means to at least reduce the supply of air to said firebox upon increase to a preselected value of the temperature in said enclosure.

5. A system as defined in claim 1 which further includes temperature-sensing means responsive to a decrease in temperature in said firebox below a predetermined level for disabling said control means from conveying said air, and which also includes a manually-operable switch for effecting operation of said control means to convey air from said supply to said firebox until limited by said thermostat means upon an increased temperature to a predetermined value.

6. A system as defined in claim 1 which further includes temperature-responsive means within said enclosure for enabling and disabling said control means in response to temperature change within said enclosure;

in which said control means governs the conveyance of air from said supply to said circulation system;

and in which said temperature-responsive means effects operation of said control means to increase the supply of air to said circulation system when the temperature in said enclosure exceeds a predetermined value.

7. A system as defined in claim 1 in which said control means governs the conveyance of air from said supply to said circulation system;

which further includes temperature-detecting means within said heat exchange system;

and in which said temperature-detecting means effects operation of said control means to increase the supply of air to said circulation system when the temperature in said heat-exchange system exceeds a predetermined value.

8. A system as defined in claim 7 which further includes temperature-responsive means with said enclosure for enabling and disabling said control means in response to temperature change within said enclosure;

and in which said temperature-responsive means also effects operation of said control means by increasing the supply of air to said system when the temperature in said heat-exchanger system exceeds a predetermined value.

9. A system as defined in claim 1 which further includes temperature-determining means for ascertaining the existance of combustion heat within said firebox;

and impelling means within said circulation system for enforcing the conduction of said air therein in response to operation of said temperature-determining means.

10. A system as defined in claim 9 which further includes a manually operable switch for effecting operation of said impelling means to convey air in said circulation system.

11. A system as defined in claim 1 in which said thermostat means further includes at least one pair of temperature sensing means mutually correlated in prevention of excessive heat in said firebox under a condition of malfunction of a portion of said thermostat means.

12. A system as defined in claim 1 in which said heat-exchange system includes a grate located within said firebox, upon or surrounding which the fire is established, and which grate includes a plurality of hollow tubes through which air is conducted as a part of said circulation system.

13. A system as defined in claim 12 in which said heat-exchange system includes a jacket spaced from and surrounding said firebox, and which further includes means for deflecting air, conducted by said circulation system, into one end of said hollow tubes.

14. A system as defined in claim 12 in which a plurality of bars are individually aligned with a plurality of generally parallel-spaced ones of said tubes and respectively disposed between successive different ones of said tubes to serve along with said tubes as a support for coals dropping between said tubes.

15. A system as defined in claim 14 in which said bars are suspended from a plurality of rods disposed transversely to and on top of a plurality of generally parallel-spaced ones of said hollow tubes.

16. A system as defined in claim 1 in which said heat-exchange system includes a jacket spaced from and surrounding said firebox and through which said circulation system conveys said air.

17. A system as defined in claim 16 in which a plurality of spaced-apart heat-conductive fins project outwardly from said firebox into the space defined by said jacket.

18. A system as defined in claim 17 in which said fins are oriented vertically and spaced around the lower portions of the side and rear vertical walls of said firebox.

19. A system as defined in claim 18 in which further ones of said fins slant upwardly and forwardly, being located on the upper portions of said sidewalls.

20. A system as defined in claim 16 in which said heat-exchange system also includes a grate located within said firebox, upon or surrounding which the fire is established, and which includes a plurality of hollow tubes through which air is conducted as a part of said circulation system.

21. A system as defined in claim 16 in which said heat-exchange system includes a plurality of conduits which convey the circulated air and extend through the upper exhaust region of said firebox, in which said heat-exchange system includes a jacket spaced from and surrounding said firebox, which further includes means for deflecting air, conducted by said circulation system, into one end of said conduits, in which the upper portion of the rear wall of said firebox slants upwardly and forwardly toward one end of each of said conduits and in which a plurality of spacedapart heat-conductive fins project outwardly from said upper portion and are disposed generally in an upright direction.

22. A system as defined in claim 21 in which a baffle is disposed in spaced overlying relationship to said fins for directing flow of said air in said circulation system along said fins.

23. A system as defined in claim 16 in which said heat-exchange system includes a plurality of conduits which convey the circulated air and extend through the upper exhaust region of said firebox, in which the upper portion of the front wall of said firebox slants upwardly and rearwardly from the lower portion thereof, in which an end of each of said conduits emerges through said upper portion, and which further includes a plurality of spaced-apart heat-conductive fins that project outward from said upper portion and are disposed generally in an upright direction.

24. A system as defined in claim 16 in which said jacket includes upstanding wall portions spaced from the corresponding walls of said firebox, in which a horizontal base plate extends between lower margins of said wall portions, in which a grate is located with said firebox and spaced above said base plate, and in which said base plate includes means defining a central opening beneath and substantially spanning the underside of said grate.

25. A system as defined in claim 16 in which said heat-exchange system includes a plurality of conduits which convey the circulated air and extend through the upper exhaust region of said firebox, in which the upper portions of the walls of said firebox are closed together to define a smoke shelf from which said exhaust outlet emerges and through which said conduits extend;

and in which baffle means projects upwardly from said smoke shelf and is spaced inwardly from the walls of said smoke shelf for permitting the thermal updraft of smoke generated in said firebox while retarding downdraft of air into said exhaust means.

26. A system as defined in claim 16 in which said heat-exchange system includes a plurality of conduits which convey the circulated air and extend through the upper exhaust region of said firebox, in which said heat-exchange system also includes a grate located within said firebox, which grate includes hollow tubes through which air is conducted as part of said circulation system, and in which such air conducted through said tubes is conveyed outwardly through the space defined by said jacket.

27. A system as defined in claim 1 in which said closure includes a door openable from within said enclosure, in which said door is supported from a collar projecting forwardly from the margin of said opening, and in which said collar is removably coupled to said firebox.

28. A system as defined in claim 27 which further includes a baffle projecting downwardly and inwardly from along the interior of the uppermost wall of said collar.

29. A system as defined in claim 1 in which said control means governs the conveyance of air from said supply to said firebox, which includes a pipe disposed transversely of said firebox near to the front and lower walls thereof, a plurality of apertures being defined in and spaced successively along said pipe with air being conveyed through said pipe and out of said apertures to form an air screen generally across the front of said firebox.

30. A system as defined in claim 1 in which said control means governs the supply of air to said firebox, which includes a pipe disposed transversely of said firebox near to the front and lower walls thereof, a plurality of openings being defined in and spaced successively along said pipe with said air being directed into said firebox through said pipe and out of said openings to fuel combustion within said firebox.

31. A system as defined in claim 1 in which said exhaust outlet includes a barometric damper, and which further includes means for communicating air from without said enclosure to the inlet of said damper.

32. A system as defined in claim 1 in which a pair of removable fireplates are disposed in said firebox adjacent to the side walls thereof.

33. In a fireplace system installed within an enclosure and including a firebox for confining the region of combustion of burnable products together with an exhaust outlet from said firebox, the improvement comprising:

a grate located within said fireplace and including a plurality of hollow tubes;

means for circulating a fluid to be heated through said tubes;

a supply of air;

and a pipe disposed transversely of said firebox near to the front and lower walls thereof and with a plurality of apertures being defined in and spaced successively along said pipe, and pipe being coupled to said supply so that said air is conveyed into said firebox through said pipe and out of said apertures to form an air screen across the front of said firebox.

34. In a fireplace system installed within an enclosure and including a firebox for confining the region of combustion of burnable products together with an exhaust outlet from said firebox, the improvement comprising:

a grate located within said fireplace and including a plurality of elongated hollow tubes having uninterrupted continuous sidewalls;

means for circulating a fluid to be heated through said tubes;

and a plurality of elongated bars, individually aligned with a plurality of generally parallel-spaced ones of said tubes and respectively disposed laterally between successive different ones of said tubes in and at an elevation between the respective levels of the tops and bottoms of said tubes, said bars being of a width occupying a sufficient amount of the space directly laterally between said tubes to serve along with said tubes to support coals, of a size which otherwise could drop between said tubes, in a position adjacent to the sides of said tubes.

35. A system as defined in claim 34 in which said bars are suspended from a plurality of rods disposed transversely to and on top of said plurality of generally parallel-spaced ones of said hollow tubes.

* * * * *